US009272306B2

(12) United States Patent
Ryabova et al.

(10) Patent No.: US 9,272,306 B2
(45) **Date of Patent: *Mar. 1, 2016**

(54) COATING MATERIAL DISTRIBUTION USING SIMULTANEOUS ROTATION AND VIBRATION

(71) Applicant: Advenira Enterprises, Inc., Sunnyvale, CA (US)

(72) Inventors: Elmira Ryabova, Sunnyvale, CA (US); Valentin Ryabov, Sunnyvale, CA (US)

(73) Assignee: Advenira Enterprises, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/515,634

(22) Filed: Oct. 16, 2014

(65) Prior Publication Data

US 2015/0151327 A1 Jun. 4, 2015

Related U.S. Application Data

(63) Continuation of application No. 14/095,854, filed on Dec. 3, 2013, now Pat. No. 8,889,222.

(51) Int. Cl.
*B05D 3/12* (2006.01)
*B05D 1/00* (2006.01)
(Continued)

(52) U.S. Cl.
CPC ..... *B05D 1/005* (2013.01); *B05D 1/002* (2013.01); *B05D 1/02* (2013.01); *B05D 1/18* (2013.01); *B05D 3/067* (2013.01); *B05D 3/12* (2013.01); *B05D 7/52* (2013.01)

(58) Field of Classification Search
CPC ..... B05D 1/005; B05D 1/002; B05D 3/12; B05D 1/02; B05D 1/18
USPC ..... 427/240, 346, 421.1, 425, 430.1
See application file for complete search history.

(56) References Cited

U.S. PATENT DOCUMENTS 5,925,410 A 7/1999 Akram et al.
7,452,568 B2 11/2008 Hougham et al.
(Continued)

FOREIGN PATENT DOCUMENTS

EP 1255165 A2 11/2002
JP H0780373 A 3/1995
(Continued)

OTHER PUBLICATIONS

"Int'l Application Serial No. PCT/US2014/060804, Search Report & Written Opinion mailed Jan. 29, 2015", 6 pgs.
(Continued)

*Primary Examiner* — Kirsten Jolley
(74) *Attorney, Agent, or Firm* — Kwan & Olynick LLP

(57) ABSTRACT

Provided are methods and systems for distributing coating materials using simultaneous vibration and rotation. Inertial forces generated during vibration and centrifugal forces generated during rotation redistribute the coating materials previously deposited on the surface resulting in uniform and/or conformal layers. The coated surfaces may have various shapes and degrees of roughness and may be referred to as complex surfaces. An initial layer of the coating material may be deposited on a complex surface of the part using dipping, spraying, spin coating, or other like techniques. The coating material is redistributed by simultaneous rotation and vibration of the part using specifically selected process conditions, such as orientation of vibrational and rotational axes relative to the part, rotational speeds, and vibrational frequencies and amplitudes. The redistribution operation may be repeated one or more times using different process conditions to ensure uniform distribution on different portions of the complex surfaces.

19 Claims, 12 Drawing Sheets

(51) Int. Cl.

| | |
|---|---|
| ***B05D 7/00*** | (2006.01) |
| ***B05D 1/02*** | (2006.01) |
| ***B05D 1/18*** | (2006.01) |
| ***B05D 3/06*** | (2006.01) |

(56) References Cited

U.S. PATENT DOCUMENTS

| | | | |
|---|---|---|---|
| 8,507,035 | B2 | 8/2013 | Ryabova |
| 8,889,222 | B1 | 11/2014 | Ryabova et al. |
| 2001/0046554 | A1 | 11/2001 | Boyee et al. |
| 2004/0047994 | A1 | 3/2004 | Becker et al. |
| 2008/0234812 | A1 | 9/2008 | Pacetti |
| 2009/0243103 | A1 | 10/2009 | Jacobs et al. |
| 2012/0301667 | A1 | 11/2012 | Ryabova |

FOREIGN PATENT DOCUMENTS

| | | | |
|---|---|---|---|
| SU | 803992 | A1 | 2/1981 |
| SU | 997832 | A1 | 2/1983 |
| WO | 2015084490 | A1 | 6/2015 |

OTHER PUBLICATIONS

"U.S. Appl. No. 14/095,854, Examiner Interview Summary mailed Sep. 22, 2014", 3 pgs.

"U.S. Appl. No. 14/095,854, Non Final Office Action mailed", 10 pgs.

"U.S. Appl. No. 14/095,854, Notice of Allowance mailed Oct. 7, 2014", 6 pgs.

Ryabova, Elmira et al., "Coating Material Distribution Using Simultaneous Rotation and Vibration", International Application Serial No. PCT/US14/60804 , filed Oct. 16, 2014, 45 pgs.

COATING MATERIAL DISTRIBUTION USING SIMULTANEOUS ROTATION AND VIBRATION

CROSS-REFERENCE TO RELATED APPLICATIONS

This application is a continuation of U.S. application Ser. No. 14/095,854, entitled "Coating Material Distribution Using Simultaneous Rotation and Vibration," filed on Dec. 3, 2013, which is incorporated herein by reference in its entirety.

TECHNICAL FIELD

The present disclosure relates generally to methods and systems for depositing coating materials onto complex surfaces and, more specifically, to methods and systems for depositing the coating materials and redistributing the coating materials on complex surfaces using simultaneous vibration and rotation.

BACKGROUND

Various thin layer deposition techniques are currently available. However, most of these techniques are designed to deposit coating materials on flat surfaces rather than rough surfaces, curved surfaces, or surfaces having various protrusions and other features extending away from the plane of the surface. Common examples of conventional thin layer deposition techniques include spin coating and roll coating. When these techniques are used on surfaces that are not flat, the coated layers are often non-uniform or at least non-conformal. Some surfaces, such as surfaces of small features extending away from the plane of the main surface, may even remain completely free from the coating material after completion of the deposition operation. Other conventional deposition techniques, such as plasma deposition and sputtering, suffer from the line-of-sight requirement. When these techniques are used, the coated surface has to be directly exposed and, often, has to be orthogonal to a coating apparatus. Still other deposition techniques, such as chemical vapor deposition, are difficult to control as precursors used in these techniques react with a surface upon immediate contact. As such, areas with high precursor concentrations have higher deposition rates than other areas, which results in non-conformal coatings. It may be difficult, if not impossible, to evenly redistribute the coating material over the entire surface.

SUMMARY

Provided are methods and systems for distributing coating materials using simultaneous vibration and rotation. Inertial forces generated during vibration and centrifugal forces generated during rotation redistribute the coating materials previously deposited on the surface, thereby resulting in uniform and/or conformal layers. The coated surfaces may be have various shapes and roughness and may be referred to as complex surfaces. An initial layer of the coating material may be deposited on a complex surface of the part using dipping, spraying, spin coating, or other like techniques. The coating material is redistributed by simultaneous rotation and vibration of the part using specifically selected process conditions, such as orientation of vibrational and rotational axes relative to the part, rotational speeds, and vibrational frequencies and amplitudes. In some embodiments, the redistribution operation may be repeated one or more time using different process conditions to ensure uniform distribution on different portions of the complex surfaces.

In some embodiments, a method for depositing a coating material onto a complex surface of a part involves depositing an initial layer of the coating material on at least a portion of the complex surface and redistributing the coating material provided in the initial layer to form a modified layer. This redistribution of the coating material involves simultaneously rotating and vibrating the part.

In some embodiments, depositing the initial layer involves one of dipping, spraying, or spin coating. However, other deposition techniques of forming uncured layers are also within scope. The coating material may be a thixotropic fluid. More generally, the coating material may be a non-Newtonian fluid. In some embodiments, the coating material is a sol-gel precursor. In some embodiments, the viscosity of the coating material increases while redistributing the coating material.

In some embodiments, the part is rotated around or about a first axis while redistributing the coating material. The part may be also vibrated along this first axis while redistributing the coating material. The complex surface may include a first portion extending substantially orthogonal to the first axis and a second portion extending substantially parallel to the first axis. A combination of rotation and vibration allows redistributing the coating material along both portions (i.e., the first portion and the second portion) at the same time.

In some embodiments, the part is rotated around or about a first axis while redistributing the coating material. The part may be vibrated along a second axis while redistributing the coating material. The second axis is orthogonal to the first axis. In these embodiments, the complex surface may include a portion extending substantially orthogonal to the first axis and substantially orthogonal to the second axis.

In some embodiments, the part is simultaneously vibrated along a first axis and along a second axis while redistributing the coating material, such that the first axis is orthogonal to the second axis. More generally, the first axis is not parallel to the second axis.

In some embodiments, the part is simultaneously rotated around or about a first axis and around or about a second axis while redistributing the coating material, such that the first axis is orthogonal to the second axis. More generally, the first axis does not coincide with the second axis. In some embodiments, the first axis is parallel to the second axis. Different rotational speeds may be used for different rotational axes.

In some embodiments, the part is rotated around or about a first axis while redistributing the coating material during a first stage. The part may be also rotated around or about a second axis while redistributing the coating material during a second stage. The first stage may not overlap in time with the first stage. The first axis may be substantially orthogonal to the second axis.

In some embodiments, the part is vibrated along a first axis while redistributing the coating material during a first stage. The part may be also vibrated along a second axis while redistributing the coating material during a second stage. The second stage may not overlap with the first stage. The first axis may be substantially orthogonal to the second axis.

In some embodiments, the modified layer covers a larger area of the complex surface than the initial layer. In other words, the initial layer spreads on the complex surface of the part and increases the coverage area when forming the modified surface layer. In some embodiments, the method also involves curing the coating material on the complex surface. The curing is performed while simultaneously rotating and vibrating the part. In some embodiments, the depositing the initial layer involves rotating or vibrating while the part is submerged in the coating material. The method may also involve determining rotating and vibrating profiles based on geometry of the part, surface conditions of the complex surface, and properties of the coating material. For example, the rotating and vibrating profiles may include orientation of one or more axes of vibration and rotation relative to the part, duration of vibration and rotation, and changes in vibration and rotation conditions.

Provided also is a method for depositing a coating material onto a complex surface of a part, which involves depositing an initial layer of the coating material on at least a portion of the complex surface by dipping the part into the coating material. The method also involves redistributing the coating material provided in the initial layer to form a modified layer. The redistribution of the coating material involves simultaneously rotating and vibrating the part. Specifically, the part may be rotated at a rotation speed of between about 100 RPM and 600 RPM. At the same time, the part may be vibrated at a frequency of between about 5 Hz and 50 Hz.

These and other embodiments are described further below with reference to the figures.

DETAILED DESCRIPTION

Figure 1:
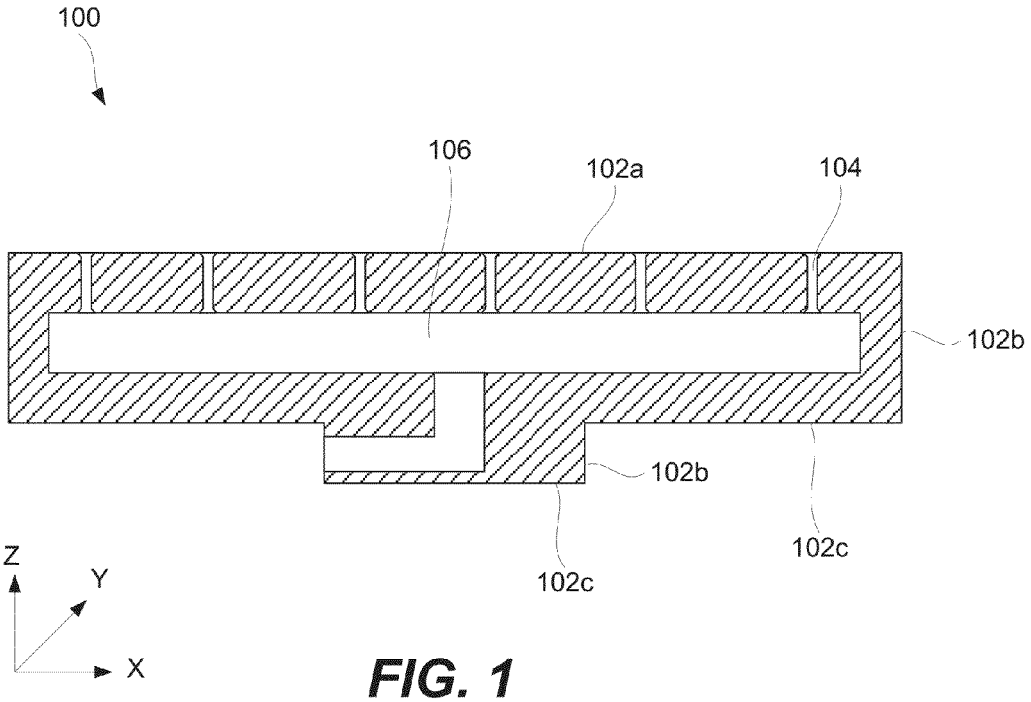
FIG. 1 is a schematic representation of a part having a complex surface, in accordance with some embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Introduction

As noted above, depositing uniform and/or conformal layers can be problematic when receiving surfaces are not flat. For purposes of this document, non-planar surfaces and/or surfaces including multiple planar portions (e.g., portions formed by three dimensional features) may be referred to as complex surfaces. A more precise definition is provided below. For example, when a coating material is disposed onto a complex surface, the gravitational force may move material from high points to low points causing non-uniform distribution. In another example, if a portion of the surface is formed by a small opening that extends from, e.g., a top surface, the coating material can collect around this opening but may not readily go inside this opening because of the surface tension, viscosity, and other phenomena. In yet another example, an opening may be completely filled with the coating material rather than forming a uniform layer on side walls of this opening. In conventional deposition techniques, redistribution of the previously applied coating material is generally limited to the gravitational forces, shearing with a straight edge, or other like techniques.

Provided are methods and systems for distributing coating materials using simultaneous vibration and rotation. An initial layer of the coating material may not be sufficiently uniform and/or may not cover the entire surface that needs to be coated. The initial layer may be deposited using various techniques, such as dipping a part into a coating material, spraying material onto the part, and other like techniques. The part is then subject to simultaneous vibration and rotation to redistribute this initially formed layer and form a modified layer. Vibration generates inertial forces, while rotation generates centrifugal forces that act on the initially formed layer. The direction and magnitude of these forces are specifically controlled using various process conditions, such as orientation of vibrational and rotational axes relative to the part, rotational speeds, and vibrational frequencies and amplitudes. These process conditions may be selected based on the surface shape and surface condition (e.g., surface roughness), coating material used (e.g., viscosity, surface tension, density, thixotropic properties), and other factors. In some embodiments, the process conditions may vary during redistribution of the coating material on the complex surface. For example, orientation of vibrational and/or rotational axes may change at least once during the process. Furthermore, the inertial and centrifugal forces may be combined with gravitational forces and, in some embodiments, with aerodynamic forces to distribute materials on complex surfaces.

In addition to combining rotation and vibration in a single operation, multi-axis rotation and/or multi-axis vibration may be used. In some embodiments, the part may be rotated around or about two or more different axes during redistribution of the material on the surface of the part. As such, the part and the coating material previously disposed on the surface of the part are subjected to multidirectional centrifugal forces, which are a combination of the centrifugal forces generated by each of the rotations. These multidirectional centrifugal forces may change their orientation as the process continues. Furthermore, the multidirectional centrifugal forces are combined with inertial forces generated by vibration.

In the same or other embodiments, the part may be vibrated along two or more non-parallel axes during redistribution of the material on the surface of the part, thereby subjecting the coating material to multidirectional inertial forces. The direction of these multidirectional inertial forces may shift by, for example, using different frequencies for different axes or offsetting the vibrational cycles of the same frequency. Furthermore, the multidirectional inertial forces are combined with centrifugal forces generated by rotation.

In this document, a "complex object" or "object with a complex surface" or grammatical equivalents refers to any object with at least one complex surface. The "complex surface" may be a non-planar surface; a combination of two or more planar surfaces meeting at any angle; at least one three dimensional internal or external feature (e.g., openings, protrusions) associated with an otherwise planar surface of the object; or various combinations thereof. One example of a complex surface is the surface of a sphere or a portion of a sphere (e.g., a half sphere forming the end surface of a cylindrical object). A cylinder sidewall is another example of a complex surface. A pyramid is an example of a complex object with its planar surfaces meeting at an angle other than 90°, whereas a cube is an example of a complex object with its planar surfaces meeting at a 90° angle. Examples of three dimensional features, the addition of which can turn a non-complex surface into a complex one, include one or more of projections, depressions, holes, orifices, surface channels, internal channels, plateaus, undulations, curvatures, embossments, trenches, mesa patterns, plenums, and various combinations thereof. In many instances, these features have a large aspect ratio, such as at least about 2, at least about 5, at least about 10, or even at least about 100. For purposes of this document, the aspect ratio is defined as a ratio of the depth to the principal dimension orthogonal to the depth (e.g., a diameter) of the feature.

FIG. 1 is a schematic representation of a part 100 having a complex surface, in accordance with some embodiments. Specifically, part 100 has a top surface 102*a*, side surface 102*b* (formed by multiple portions), and bottom surface 102*c* (also formed by multiple portions). These surfaces 102*a*-102*c* may not qualify as complex surfaces under the definition provided above. In some embodiments, part 100 is a round object and side surface 102*b* may qualify as a complex surface. Furthermore, surfaces 102*a*-102*c* are all external surfaces and may be easily coated. However, part 100 has many features having internal surfaces that are not easily coated. For the purposes of this document, internal surfaces are defined as surfaces that extend away from the external boundary of the object. Specifically, part 100 has multiple openings 104 extending away from top surface 102*a*. Openings 104*a* may have chamfers at their inlets on both sides as, for example, shown in FIG. 1. When a conventional coating technique is used to apply a coating material onto top surface 102*a*, the material may not sufficiently penetrate into openings 104 and coat the side walls of these openings. Some deficiencies of conventional methods and unexpected results of the proposed methods are presented in the experimental result section presented below. Furthermore, part 100 includes external cavity 106 and its surfaces may not be reachable for direct (e.g., line of sight) coating.

A complex surface may be characterized with a coefficient of complexity. As used herein, the "coefficient of complexity," "complexity coefficient," or grammatical equivalent is the ratio of the total surface area to the largest two-dimensional projected area of that surface on another planar surface. A planar surface has a coefficient of complexity of 1. A complex surface has a coefficient of complexity of greater than 1. For example, the coefficient of complexity for a sphere is 4 (i.e., surface area of $4\pi R^2$ divided by the projection area of $\pi R^2$). In a similar manner, the complexity of a half sphere is 2 since it has the same projection area as the sphere but only half the surface. In some embodiments, the complexity coefficient of a surface is at least about 2, or, more specifically, at least about 3, or even at least about 4, at least about 5, or at least about 6. Various computer assisted drawing (CAD) tools can be used to calculate the complex surface.

The foregoing describes complex surfaces on the macroscopic scale. In other words, any features that are less than 1 millimeter are ignored for estimates of complexity of the surface unless specifically noted. When specifically noted, complex surfaces can also be characterized on the microscopic (micron) and nanoscopic (nanometer) scale. In general, most surfaces have some degree of surface roughness (R), typically measured on the microscopic or nanoscopic scale. This roughness can be random because of the composition used to make the object and how it was manufactured. The roughness may also be the result of intentionally forming microscopic or nanoscopic features on a surface. In each case, the surface roughness is caused by surface features which, when viewed in isolation, are themselves microscopic or nanoscopic complex objects with complex surfaces. They also contribute to the complexity coefficient of the surface since they increase the effective surface area under consideration.

The coated layer formed with methods and systems described herein may have a thickness between about 1 μm and 1000 μm, such as between about 1 μm and 500 μm, between about 1 μm and 250 μm, between about 1 μm and 100 μm or even between about 1 μm and 10 μm. The coated layers can be conformal, which is defined as layers that conform to the features associated with a surface. For example, a conformal layer will conform to a rough surface and still maintain its uniform thickness. Alternatively, the layer can form a flat top surface despite the roughness of the part surface. In some embodiments, a conformal layer is defined by its thickness as compared to the roughness of the surface. In general, a thin layer is conforming if the thickness (T) is less than the half of the roughness (R/2). If the thickness (T) is greater than double the roughness (2R), then a thin layer generally forms a flat surface or a leveled surface. In other words, the deposited layer levels out the surface roughness. Other parameters that would differentiate the layer being conformal or flat include viscosity of the coating material, surface tension, processing conditions used for redistribution and curing of the material. In some embodiments, a layer that is initially flat is redistributed into a conformal layer.

In some embodiments, a coating material covers only a portion of the complex surface. The processing parameters may be selected in such a way that the coating material is not distributed over the entire available surface area. For example, some areas need to be maintained free from the coating material. Instead of using a masking layer or other protective techniques, processing parameters (including vibration and rotation parameters) may be selected in such a way as to avoid distribution of the coating material into certain areas.

In some embodiments, a multilayered structure may be formed using described methods and systems. For example, a process may be repeated multiple times using the same or different coating materials to form a multilayered structure. The thickness and/or composition of layers in a multilayered structure may differ.

For the purposes of this document, the term "uniform thin layer" or grammatical equivalents refer to the thin layer having a uniform thickness. A thin layer has a uniform thickness if the thickness varies less than a pre-selected value (e.g., between 1% and 20%, such as less than 5%) for the entire layer. Various factors including, but not limited to, substrate material, surface finish and roughness, and type of coating, may effect the uniformity of the layer.

In some embodiments, a coated layer is covalently attached to the surface of an object. The covalent bond formed during covalent attachment is a chemical bond that involves the sharing of electron pairs between atoms of two materials. The covalent bonding may be established during coating and/during curing of the material on the coated surface. Covalent bonding provides improved adhesion of the material to the surface. Furthermore, increased adhesion of the coating material to the surface can be produced by treating the surface prior to the coating application to increase the number of chemically reactive groups or atoms on the surface. These chemically reactive groups or atoms react with one or more components in the coating fluid so that the resulting thin layer is attached to the surface by more covalent bonds than would be the case without surface pre-treatment. For example, plasma treatment may be used. When a multilayer film stack is produced, each of the coating layers can be treated with plasma prior to adding the coating solution that forms the next layer, or some layers can be treated selectively based on the stack composition. In this way, increased adhesion between layers and between the multilayer stack and the surface of the object can be achieved. In essence this treatment enhances the performance of the coating by increasing the strength of the links between layers and between the multilayer stack and the surface of the object.

Coating Material Examples

Various coating materials may be deposited using described methods and systems. In some embodiments, organic polymers, organic monomers, and sol-gel precursors may be included into coating materials. For example, a coating material may include one or more sol-gel metal precursors and/or one or more sol-gel metalloid precursors. A coating material may also include a polar protic solvent and/or a polar aprotic solvent. The concentration of a polar protic or a polar aprotic solvent in such a coating material may be between 1% and 25% by volume.

The metal in sol-gel metal precursors and other types of metal containing precursors can be a transition metal, a lanthanide, an actinide, an alkaline earth metal, one of Group IIIA through Group VA metals. Various combinations of theses metals may be also used in the same coating material. Specific examples include aluminum (Al), titanium (Ti), molybdenum (Mo), tin (Sn), manganese (Mn), nickel (Ni), chromium (Cr), iron (Fe), copper (Cu), zinc (Zn), gallium (Ga), zirconium (Zr), yttrium (Y), cadmium (Cd), lithium (Li), samarium (Sm), erbium (Er), hafnium (Hf), indium (In), cerium (Ce), calcium (Ca) and magnesium (Mg). The metalloid in the sol-gel metalloid precursors can be one or more of boron (B), silicon (Si), germanium (Ge), arsenic (As), antimony (Sb), tellurium (Te), bismuth (Bi) and polonium (Po) or combinations thereof with another metalloid or metal. In some embodiments, the sol-gel metal precursor can be metallic compounds selected from organometallic compounds, metallic organic salts and metallic inorganic salts. The sol-gel metalloid precursors can be metalloid compounds selected from organo-metalloid compounds, metalloid organic salts and metalloid inorganic salts. When more than one metal or metalloid is used, one may be an organic compound, such as an alkoxide, and the other one may be an organic or inorganic salt.

In some embodiments, the polar protic solvent used in the coating material is an organic acid or alcohol (for example, a lower alkyl alcohol, such as methanol and ethanol). Water may also be present in the coating material. In some embodiments, the polar aprotic solvent can be a halogenated alkane, alkyl ether, alkyl ester, ketone, aldehyde, alkyl amide, alkyl amine, alkyl nitrile, or alkyl sulfoxide. Some specific examples of such polar aprotic solvents include methyl amine, ethyl amine, and dimethyl formamide. In some embodiments, an acid or a base, which is used as a catalyst for polymerization of the metal and/or metalloid precursors, can be added before or after the addition of the polar aprotic solvent.

Excessive amounts of the polar aprotic solvent can cause gelation of the coating material. Accordingly, the amount of polar aprotic solvent can be determined empirically for each application. The amount of polar aprotic solvent needs to be below the amount that causes gelation during mixing but be sufficient to cause gelation of the coating material after a shear force is applied to the coating material (e.g., during redistribution of the coating material on the complex surface).

In some embodiments, a coating material is a non-Newtonian solution, which may be a shear-thinning solution, a dilatant solution, a rheopectic solution, or a thixotropic solution. As used herein, "shear-thinning" refers to a solution that has a dynamic viscosity decreasing in a non-linear manner as shear forces are applied to the solution; "dilatant" refers to a solution that has a dynamic viscosity increasing in a non-linear manner as shear forces are applied to the solution; "rheopectic" refers to a solution that has a dynamic viscosity increasing with the duration of stress; and "thixotropic" refers to a solution that has a dynamic viscosity decreasing with the duration of stress.

In some embodiments, the coating material forms a gelled layer on a surface after completing the redistribution operation. As used herein, the term "gelled layer" or grammatical equivalents mean a layer in which the metal and/metalloid sol-gel precursors in a coating material form sufficiently large and/or cross-linked polymers. Such a layer may have a sufficiently high viscosity that prevents further redistribution of the layer by gravity alone. The gelled layers can include polymerizable moieties, such as organic monomers, and cross-linkable oligomers or polymers. Examples include a base catalyzed reaction between melamine (or resorcinol) and formaldehyde followed by acidization and thermal treatment.

In some embodiments, a coating material includes one or more cross-linkable monomers covalently attached to the metal or metalloid (e.g., via an organic linker). Examples include diorganodichlorosilanes that react with sodium or sodium-potassium alloys in organic solvents to yield a mixture of linear and cyclic organosilanes. When cross-linkable moieties are used, the coating material may also contain a polymerization initiator. Examples of photo-inducible initiators include titanocenes, benzophenones/amines, thioxanthones/amines, bezoinethers, acylphosphine oxides, benzilketals, acetophenones, and alkylphenones. Furthermore, radiation-inducible initiators with corresponding wavelengths in ultraviolet UVA (315-400 nm) and UVB (280-315 nm), and infrared IR (700 nm-1 mm) regions may be used. A specific example includes heat inducible initiators.

Once the coating material is deposited, all or most solvent may be removed from the layer. The solvent can be removed by evaporation at ambient temperature, evaporation by exposure to an increased temperature (e.g., using UV, visible or IR radiation), or vacuuming. Solvent evaporation conditions can be also used for polymerization of any unreacted or partially reacted metal and/or metalloid precursors.

The total amount of metal and/or metalloid precursors in the coating material may be between about 5% and 40% by volume when the material is deposited onto the surface and redistributed on the surface. In some embodiments, the amount is between about 5% and 25% by volume or, more specifically, between about 5% and 15% by volume. The polar protic solvent may make up most of the solvent in the coating material.

Processing Examples

Figure 2:
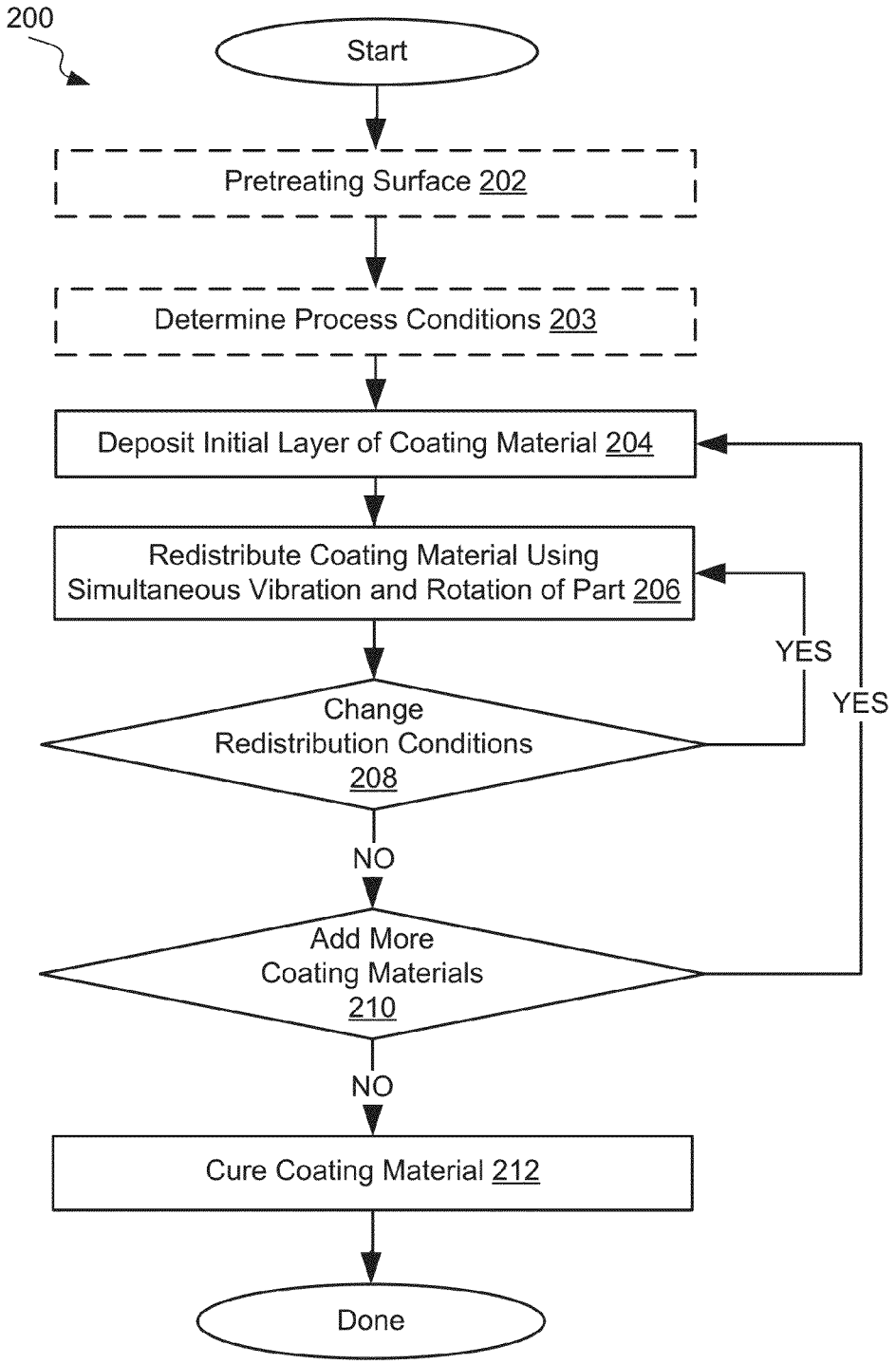
FIG. 2 is a process flowchart corresponding to a method for depositing a coating material onto a complex surface of a part, in accordance with some embodiments.

FIG. 2 illustrates a process flowchart corresponding to a method 200 for depositing a coating material onto a complex surface of a part, in accordance with some embodiments. In general, method 200 involves depositing an initial layer of the coating material on at least a portion of the complex surface during operation 204 and then redistributing the coating material provided in the initial layer to form a modified layer during operation 206. One or both of these operations may be repeated to deposit additional coating material and/or to redistribute the coating material using different combinations of centrifugal, inertial, gravitational, and centripetal forces.

Method 200 may also involve other operations as, for example, illustrated in FIG. 2. For example, a complex surface may be pre-treated during operation 202, specific process conditions (for use during operation 204 and/or operation 206) may be determined during operation 203, and the coating materials may be cured during operation 212. However, some of these operations are optional and may not be performed in some embodiments. Furthermore, method 200 may include other operations that are not shown in FIG. 2 and that will be understood by one having ordinary skills in the art. The described operations may be arranged in any order unless specifically noted. For example, operation 203 illustrated in FIG. 2 may be performed before operation 202 or after operation 204. Various aspects of method 200 will now be described in more detail.

In some embodiments, method 200 may commence with pretreating the substrate during optional operation 202. For example, plasma pre-treatment may be used during this operation. Pre-treatment may be used to modify surface properties, such as to change surface tension and/or functionalize the surface by adding or removing certain materials. At least a portion of the complex surface may be contacted with atmospheric plasma or oxygen plasma. The plasma may be provided from a plasma treatment apparatus or, more specifically, from a plasma head. The plasma head can be stationary and the part may be rotated around or about one or more axes in order to expose various portions of the surface to the plasma. Alternatively, a movable plasma head may be used, such as a plasma head with six axes of rotation.

The pre-treatment of the surface (e.g., using plasma) may functionalize the surface leading to more covalent bonds formed between the surface and the coating material. As such, pre-treatment may be used to improve adhesion. In some embodiments when a multilayered structure (or stack) is formed, each deposited layer may be treated prior to depositing another layer. For example, post-deposition treatment of the first layer surface can be used to increase adhesion of the second layer disposed over the first layer.

In some embodiments, operation 202 may involve disposing an activation solution (e.g., an acid or a base) on a complex surface. For example, a part may be immersed into the activation solution. The part may be rotated and/or vibrated while immersed into the solution and/or when removed from the solution.

In some embodiments, method 200 may involve determining process conditions (for use in later operations) during optional operation 203. For example, process conditions used during operation 204 and/or operation 206 may be determined during operation 203. Various factors, such as surface geometry, surface conditions (materials, finishes, and the like), coating material characteristics (e.g., surface tension, viscosity, specific gravity), coating equipment capabilities, and other like factors, may be considered to determine the suitable process conditions. The process conditions may include instructions for operating the coating equipment, such as timing of each operation, orientation of the part with respect to each rotational and vibrational axis during each operation, rotational and vibrational processing conditions (e.g., rotational speeds, directions, vibrational frequencies, amplitudes, and the like), coating material conditions (e.g., viscosity, density), and the like. As noted above, an output of operation 203 may be a recipe for performing operation 204 and/or operation 206. In some embodiments, output of operation 203 may indicate that operation 206 should be repeated one or more times using different process conditions. For example, a part may include a top surface and an opening extending away from the top surface. Operation 206 may be performed multiple times to (1) introduce coating material into the opening, (2) distribute the coating material along the depth of the opening, and (3) distribute the coating materials around the perimeter of the opening. Each of these operations may use a different set of processing conditions, thereby creating different combinations of centrifugal and inertial forces acting on the coating material at different times. A circular rotation at 100-1000 RPM or, more specifically, at 200-500 RPM with either a step function change or a continuous change of the tilt angle of the rotational axis may be used to distribute the coating material on a surface a cylindrical part.

Operation 203 may be performed using a computer system. The information about the part, coating equipment, and/or coating solution may be received by this computer system and used to develop a set of instructions for operating the coating equipment. In some embodiments, a CAD of the part may be used by the computer system during execution of operation 203.

Method 204 may proceed with depositing an initial layer of the coating material on at least a portion of the complex surface during operation 204. The coating material may be initially deposited using dipping, spraying, spin coating, or other like techniques. In some embodiments, most of the external surface of the part may receive the coating material, while some of the external surfaces may remain uncovered with the coating material at the end of operation 204. These uncoated portions of the complex surface may receive the coating during operation 206. As such, the coating material deposited during operation 204 may be then distributed into new areas during operation 206. Furthermore, a layer of the coating material deposited during operation 204 may not be sufficiently uniform. For example, some portions of the complex surface may have thicker layers, while other portions may have thinner layers. During operation 206, the coating material from these thicker layer portions may be moved into the thinner layer portions.

Figure 3A:
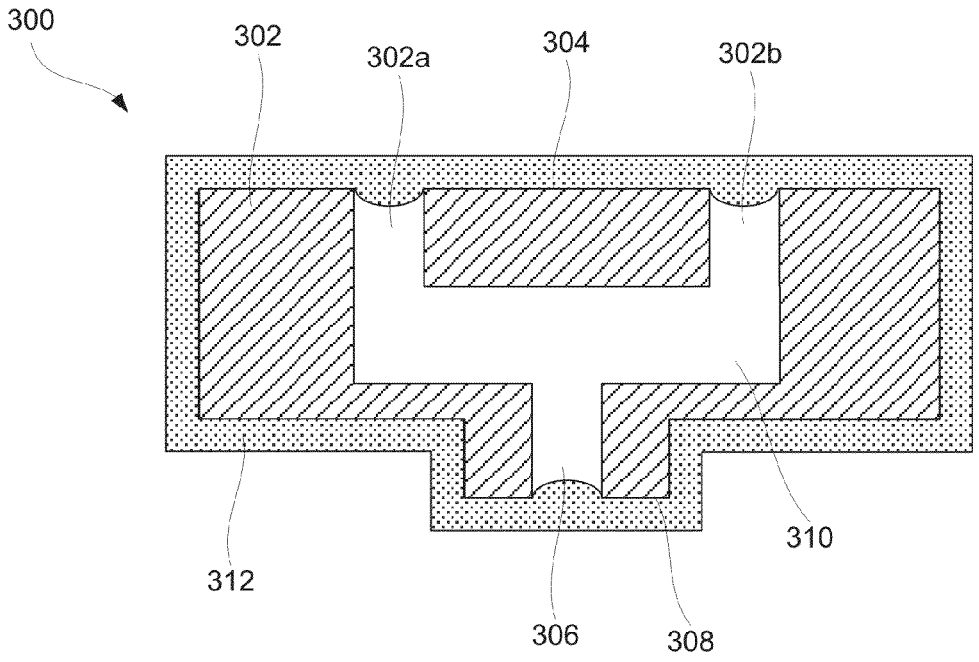
FIG. 3A is a schematic representation of a part after forming an initial layer on its surface, in accordance with some embodiments.

FIG. 3A is a schematic illustration of an initially coated part 300 having an initial coating layer 312 disposed on some of its external surfaces, in accordance with some embodiments. Numeral 302 refers to a part without any coating material on it, e.g., a part prior to dipping into a coating material. As such, initially coated part 300 may be viewed as a combination a part 302 and an initial coating layer 312 disposed on the external surface of part 300. In an initial coating layer 312, most of the internal surfaces may remain free from the coating material. Part 302 has two openings 302*a* and 302*b* extending orthogonally to top surface 304 and one opening 306 extending orthogonal to bottom surface 308. Furthermore, part 302 may include an internal cavity 310 that interconnects openings 302*a*, 302*b*, and 306 as shown in FIG.

3A. This part 302 may conceptually represent an electrostatic chuck for supporting a wafer during processing, or a showerhead (a gas distribution plate), whether passive or an electrode, for delivering the process gas.

After dipping part 302 into the coating material, top surface 304, bottom surface 308, and other external surfaces are covered with initial coating layer 312. However, internal surfaces of openings 302*a*, 302*b*, and 306 and internal cavity 310 remain free from the coating material at this stage of the overall process. Even if some material gets into openings 302*a*, 302*b*, and 306 and/or internal cavity 310, distribution of this material may not be even as, for example, shown in FIG. 3C and further described below.

The uneven distribution of the coating material at this stage may be attributed to various factors, such as coating material characteristics, surface characteristics, and processing conditions. If, for example, part 302 is dipped into the coating material, the surface tension and gravitational forces are generally the two main forces acting on the coating material and may not be sufficient to provide uniform distribution of the coating material. In some embodiments, part 302 may be rotated and/vibrated during operation 204, but centrifugal and/or inertial forces may still not be not sufficient. For example, rotational speeds and vibrational frequencies may be limited when the part is still submerged into the coating material.

Returning to FIG. 2, method 300 may proceed with redistributing the coating material provided in the initial layer on the complex surface of the part during operation 206. This redistribution of the coating material creates a modified layer. The modified layer may cover additional surfaces of the part that were not previously covered by the initial layer. As such, the average thickness of the modified layer may be less than the average thickness of the initial layer. Furthermore, the thickness of the modified layer may be significantly more uniform that that of the initial layer.

Figure 3B:
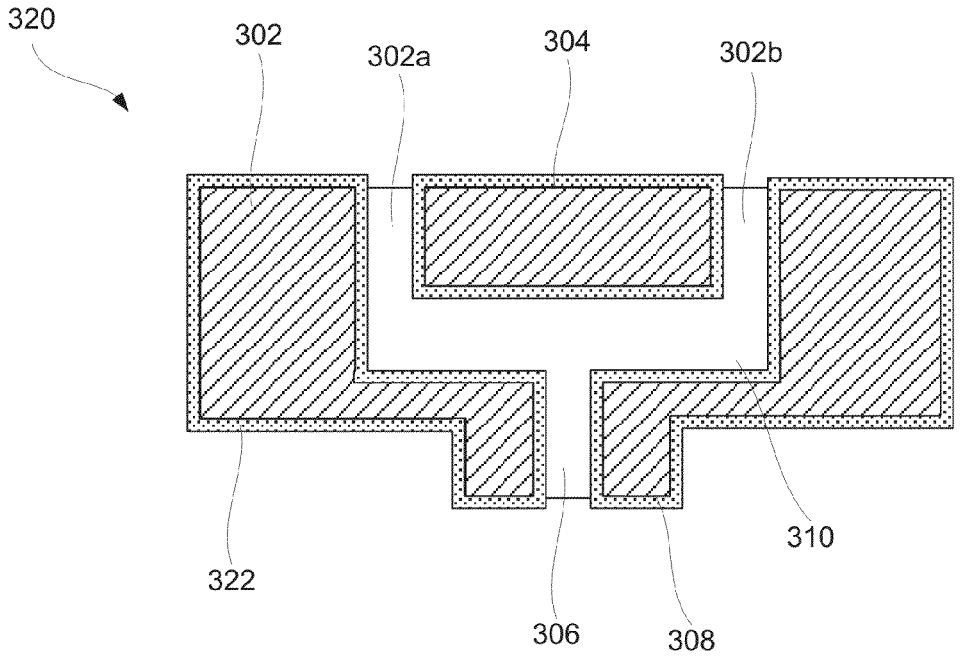
FIG. 3B is a schematic representation of the part shown in FIG. 3A after completing the method for depositing the coating material, in accordance with some embodiments.

FIG. 3B is a schematic illustration of a fully processed part 320 after performing one or more operations 206, in accordance with some embodiments. Part 320 now has a modified layer 322, which uniformly covers external surfaces 304 and 308 and internal surfaces (i.e., surfaces of the openings 302*a*, 302*b*, and 306 and internal cavity 310). Comparing FIG. 3A to FIG. 3B, the coating material in initial layer 312 is rearranged (e.g., by moving some of the material onto the internal surfaces) and thinning initial layer 312 on external surfaces 304 and 308, thereby forming modified layer 322.

Redistributing the coating material during operation 206 involves the simultaneous rotation and vibration of the part to create a combined set of forces acting on the coating material and causing the coating material to redistribute on the complex surface. As noted above, rotation of the part creates centrifugal forces acting on the coating material. These centrifugal forces are directed orthogonally to the one or more axes of rotation. Vibration of the object creates inertial forces also acting on the coating material. These forces are directed parallel to one or more axes of vibration. In addition to the centrifugal and vibrational forces, gravitational forces continuously act on the coating material. Finally, when the object is rotated and vibrated in a non-vacuum environment, aerodynamic drag farces can be created, thereby further causing redistribution of the coating material. Overall, a complex set of forces may be applied to the coating material at the same time during operation 206 to create a more conformal and uniform coverage of the part with the coating material. The vibration and rotation parameters may be specifically controlled to achieve a desired result. Various examples of such controls will now be described.

The rotational speeds used for rotation around any of the axes can be between about 1 rpm and 5000 rpm. In some embodiments, the lower rotational speed limit can be about 2, 3, 4, 5, 6, 7, 8, 9, 10, 25, 50, 75, 100, 125, 150, 200, 250, 500, 750, 1,000, 1500 or 2,000 rpm, while the upper rotational speed limit can be 4500, 4000, 3500, 3000, 2500, 2000, 1500, 1000, 500, 250 or 100 rpm. The rotational speed range can be any combination of these upper and lower limits. Some illustrative ranges are rotational speeds between about 3-1000 rpm, rotational speeds between about 3-500 rpm, rotational speeds between about 4-1000 rpm, rotational speeds between about 4-500 rpm, rotational speeds between about 5-1000 rpm, rotational speeds between about 5-500 rpm, rotational speeds between about 10-1000 rpm, rotational speeds between about 10-500 rpm, rotational speeds between about 25-1000 rpm, rotational speeds between about 25-500 rpm, rotational speeds between about 50-1000 rpm, rotational speeds between about 50-500 rpm, rotational speeds between about 100-1000 rpm, rotational speeds between about 100-500 rpm, rotational speeds between about 150-1000 rpm, or rotational speeds between about 150-500 rpm.

The number of revolutions during operation 206 can range between about 1-5000 revolutions or higher depending on the application. The lower revolution limit can be 2, 3, 4, 5, 6, 7, 8, 9, 10, 25, 50, 75, 100, 125, 150, 200, 250, 500, 750, 1,000, 1500 or 2,000 revolutions, while the upper revolution limit can be 4500, 4000, 3500, 3000, 2500, 2000, 1500, 1000, 500, 250 or 100 revolutions. In some embodiments, the part does not make a complete revolution but is turned back and forth around an axis. The turning angle may be between about 5° and 355° or, more specifically, between about 10° and 350°, such as between 90° and 270°. The frequency of turning may be between about 1 Hz and 100 Hz or, more specifically, between about 5 Hz and 50 Hz.

The vibrational frequency may be between about 1 Hz and 100 Hz or, more specifically, between about 5 Hz and 50 Hz. Amplitude of vibrations may be greater than the depth of the hole and, in case of coating semiconductor processing equipment, the amplitude may be between about 1 millimeter and 50 millimeters.

In some embodiments, the part is rotated around or about a first axis while redistributing the coating material during operation 206. Furthermore, the part may be vibrated along the same first axis. As noted above, rotation of the part generates centrifugal forces directed orthogonally and away from the first axis, while vibration generates inertial forces directed along the first axis. As such, when both the centrifugal forces and the inertial forces act on the coating material, the coating material is forced in two different directions, which may be beneficial to distribute the coating on the planar surface and non-planar surfaces. For example, one of these forces may bring the coating material to the inlet of the opening, while another force may direct the coating material into the opening. Distribution of the coating material on different surfaces of the part using this combination of rotation and vibration will now be described in more detail with reference to FIGS. 4A-4C.

Figure 4A:
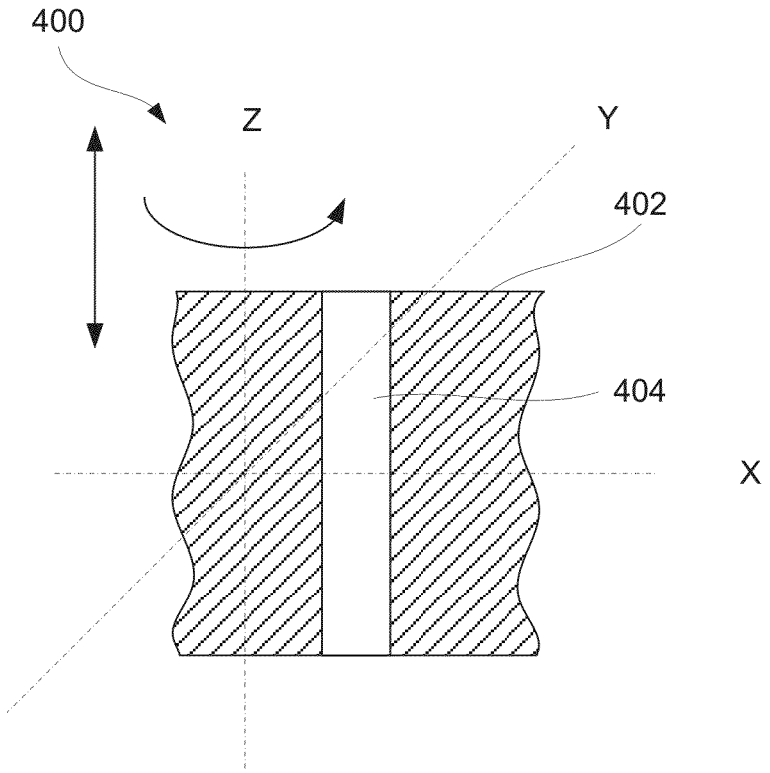
FIG. 4A is one example of orientating vibration and rotation axes relative to the feature of a part.

FIG. 4A is a schematic illustration of a part 400 having an opening 404 extending orthogonally to top surface 402 of part 400, in accordance with some embodiments. The X, Y, Z directions are shown to provide reference. These axes are fixed with respect to the part but may move with respect to the apparatus as further described below with reference to FIGS. 4B-4C. In the example shown in FIG. 4A, part 400 is rotated around or about the Z axis and vibrated along the Z axis. The rotation distributes the material away from the Z axis. Specifically, in the illustrated example, the rotation creates a centrifugal force that may direct the coating material on top surface 402 away from the Z axis and, for example, to opening 404. At the same time, the vibration distributes the material away from its current location along the Z axis. As such, if some coating material is aggregated near the inlet of opening 404, the vibration can help this material to get into opening 404. As noted, the inertial and centrifugal forces may be combined with gravitational forces. In the example shown in FIG. 4A, the gravitation force may be directed along the Z, axis thereby further helping the coating material to get into the opening.

In some embodiments, the part is rotated around or about a first axis while redistributing the coating material. However, the part is vibrated along a second axis that may be orthogonal to the first axis or at least not parallel to the first axis. When the rotational and vibrational axes are not parallel, the rotation of the part changes the orientation of the vibrational axis with respect to the part, which is further described below with reference to FIGS. 4B and 4C. This feature may be used for controlling distribution of the coating material on a complex surface.

Figure 4B:
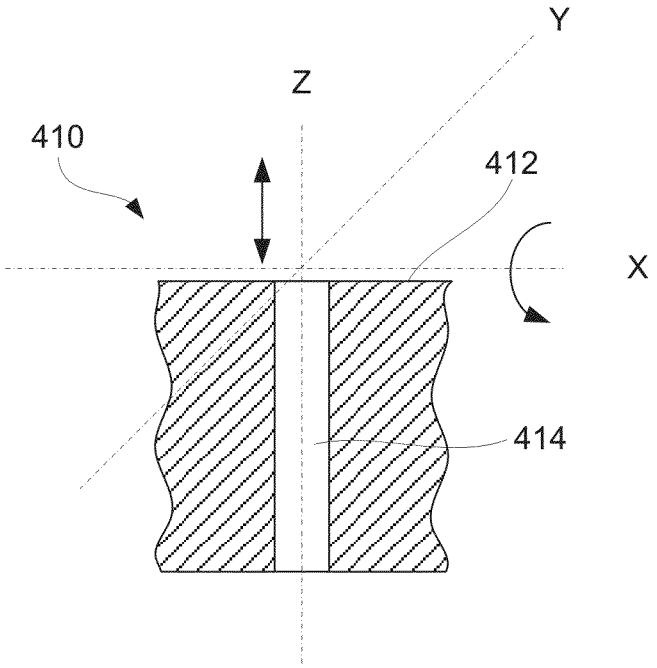
FIGS. 4B and 4C are two additional examples of orientating vibration and rotation axes relative to the feature of the part shown in FIG. 4A.
Figure 4C:
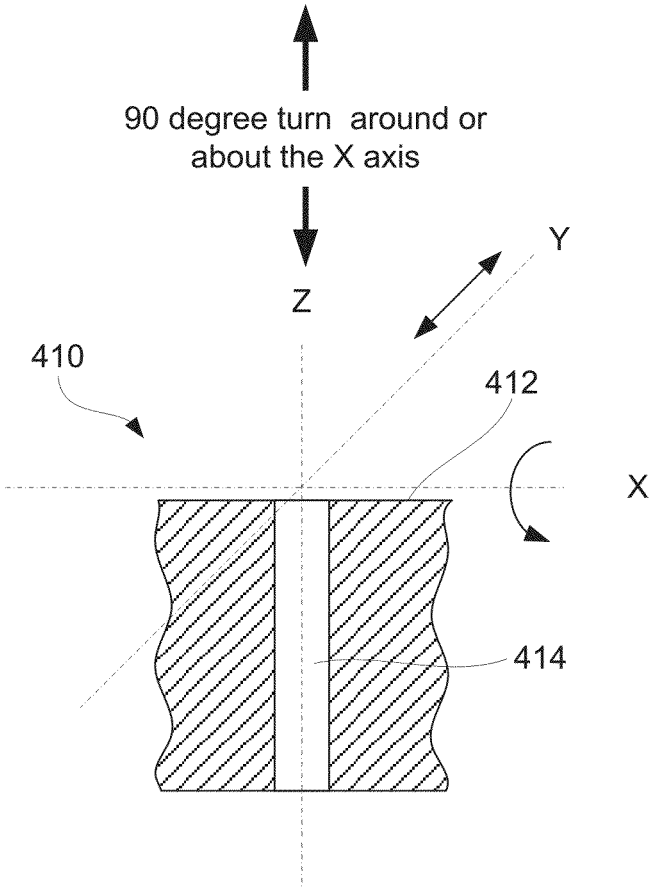

Specifically, FIG. 4B is a schematic illustration of a part 410 similar to the part 400 shown in FIG. 4A. Part 410 also has an opening 414 extending orthogonally to top surface 412. However, part 410 is rotated around the X axis. As stated above, the X, Y, and Z axes are fixed with respect to the part, but they can change with respect to the equipment used to rotate and vibrate the part. In the instant shown in FIG. 4A, the vibrational axis is parallel to the Z axis. However, as part 410 is turned 90° with respect to the X axis (as a part of the rotation), the vibrational axis is now parallel to the Y axis as shown in FIG. 4C. Overall, as part 410 is rotated around or about the X axis, its vibrational axis also rotates around or about the X axis (i.e., within the Y-Z plane). In some embodiments, in addition to or instead of providing centrifugal forces, the rotation/tilting may be used for controlling orientation of inertial forces created by vibration.

In some embodiments, vibrations may be performed along the two or more axes that are not parallel to each other. For example, one of these axes may be orthogonal to one other axis. This multi-axis vibration is performed while rotating the part around or about a rotational axis, which may be parallel and/or orthogonal to one or more of the multiple vibrational axes. Likewise, rotations may be performed along the two or more different axes. The multiple rotational axes may be parallel to each other or not. For example, one of these axes may be orthogonal to one other axis. This multi-axis rotation is performed while vibrating the part around or about a vibrational axis, which may be parallel and/or orthogonal to one or more of the multiple rotational axes. Furthermore, a part may be simultaneously vibrated along multiple non-parallel vibration axes and rotated around or about multiple rotational axes. Such multi-axial rotation may be achieved using various gimbal-type apparatuses.

Returning to FIG. 2, operation 206 may be repeated one or more times as illustrated by decision block 208. Each new operation 206 may be performed using different processing parameters. For example, rotational speeds, rotational axis orientations, vibrational frequencies, vibrational amplitudes, vibrational axis orientations, and other like process parameters may change from one operation 206 to another. In fact, a series of operations 206 may be specifically configured to ensure uniform distribution of the coating material over the entire surface. For example, when a part has one or more openings similar to part 300 in FIG. 3A, initial operation 206 may be designed to introduce the coating material into the opening while one or more subsequent operations 206 may be designed to distribute the introduced coating material within these openings. The recipe derived during operation 203 may be used to change the process parameters during multiple redistribution operations 206.

Furthermore, operations 206 and 208 may be repeated one or more times as illustrated by decision block 210. For example, after initial redistribution of the coating material, additional coating material may be added onto the external surface of the part during operation 206 followed by another redistribution operation 208. The number of these repetitions may depend on the ratio of the internal surface to the internal surface of the part. The larger the ratio, the more repetitions may be used to cover all surfaces with adequate amounts of material.

In some embodiments, the viscosity of the coating material increases during operation 206 (i.e., while redistributing the coating material). This increase in viscosity may be attributed to loss of solvents, partial curing, and/or other phenomenon. Furthermore, the viscosity of the coating material may increase immediately after completing operation 206 when centrifugal and/or inertial forces are not acting on the coating material anymore. This increase may be due to thixotropic properties of the coating material.

In some embodiments, additional coating material may be added to the part after performing some initial distribution, as shown by decision block 210. In other words, operation 204 may be performed one more time after competing at least one operation 206. For example, a part may be dipped into a coating material and subjected to redistribution in such a way that most of the material goes into the openings. In the same or other examples, some of the material may be lost from the part (e.g., by dripping) during redistribution. The part may be dipped into the coating materials a second time to provide additional coating material. In some embodiments, process parameters may vary between different operations 204. For example, a less viscous coating material may be used during initial operation 204 and a more viscous coating material may be used during subsequent operations.

Method 200 may also involve curing the coating material on the complex surface during operation 212. Curing may involve heating, radiation, and/or air flow enforced evaporation. In some embodiments, curing is performed while simultaneously rotating and/or vibrating the part to ensure maintaining distribution of the coating material on the surface during curing. In some embodiments, operation 212 may be performed in an oven or a chamber, in which reactive gases can be introduced. In some embodiments, the unit may include at least one irradiation subunit, such as a UV irradiation subunit, a visible irradiation subunit, and an IR irradiation subunit. At least one of the wavelength, intensity, and duration of radiation may be changed during operation 212. Laser based curing can be also used.

Apparatus Examples

Figure 5A:
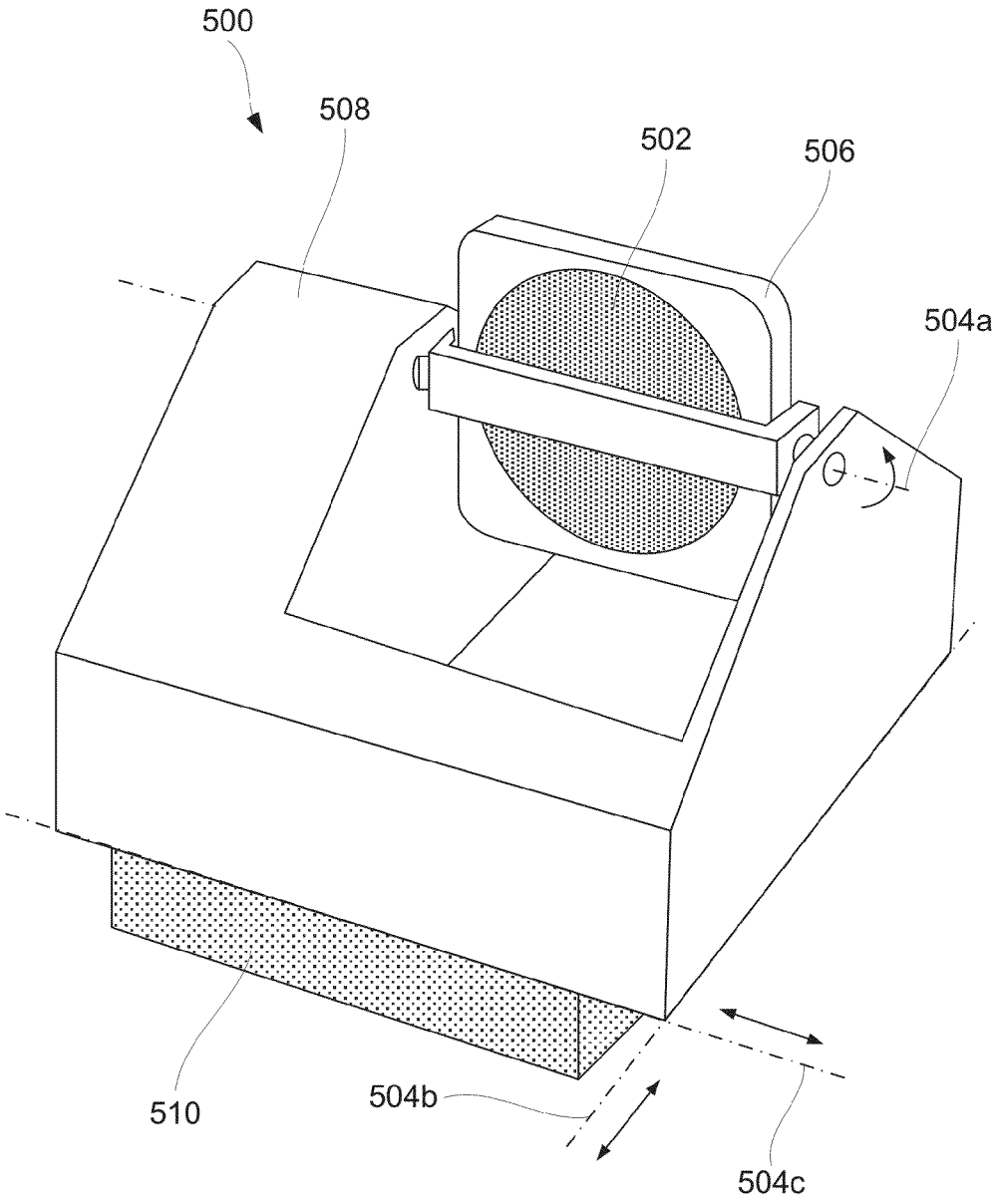
FIG. 5A is a schematic representation of an apparatus for depositing a coating material onto a complex surface of a part using at least one axis of rotation and one or more axes of vibration, in accordance with some embodiments.

FIG. 5A is a schematic illustration of a processing apparatus 500 configured to rotate a part 502 around one axis 504*a* and vibrate part 502 along two other axes 504*b* and 504*c*, in accordance with some embodiment. In the illustrated example, rotational axis 504*a* is parallel to one of the vibrational axis (i.e., axis 504*c*). However, one having ordinary skills in the art would understand that other examples are also within the scope. Part 502 is shown as a round object (e.g., a wafer, a wafer chuck, a shower head for processing a wafer). In general, part 502 may have any shape or form. Part 502 is rigidly held in a support 506. Support 506 may be engaged after depositing an initial layer of the coating material. Alternatively, support 506 may be engaged prior to depositing the initial layer. Support 506 is configured to rotate with respect to body 508 around or about axis 504*a*. Body 504 may include a motor to perform this operation. Body 504 is positioned on vibrating table 510 that is configured to vibrate body along axes 504*b* and 504*c*. In some embodiment, the processing apparatus also includes a controller for controlling operation of one or more motors used for rotation of the part and one or more vibrating devices (e.g., a vibrating table).

Figure 5B:
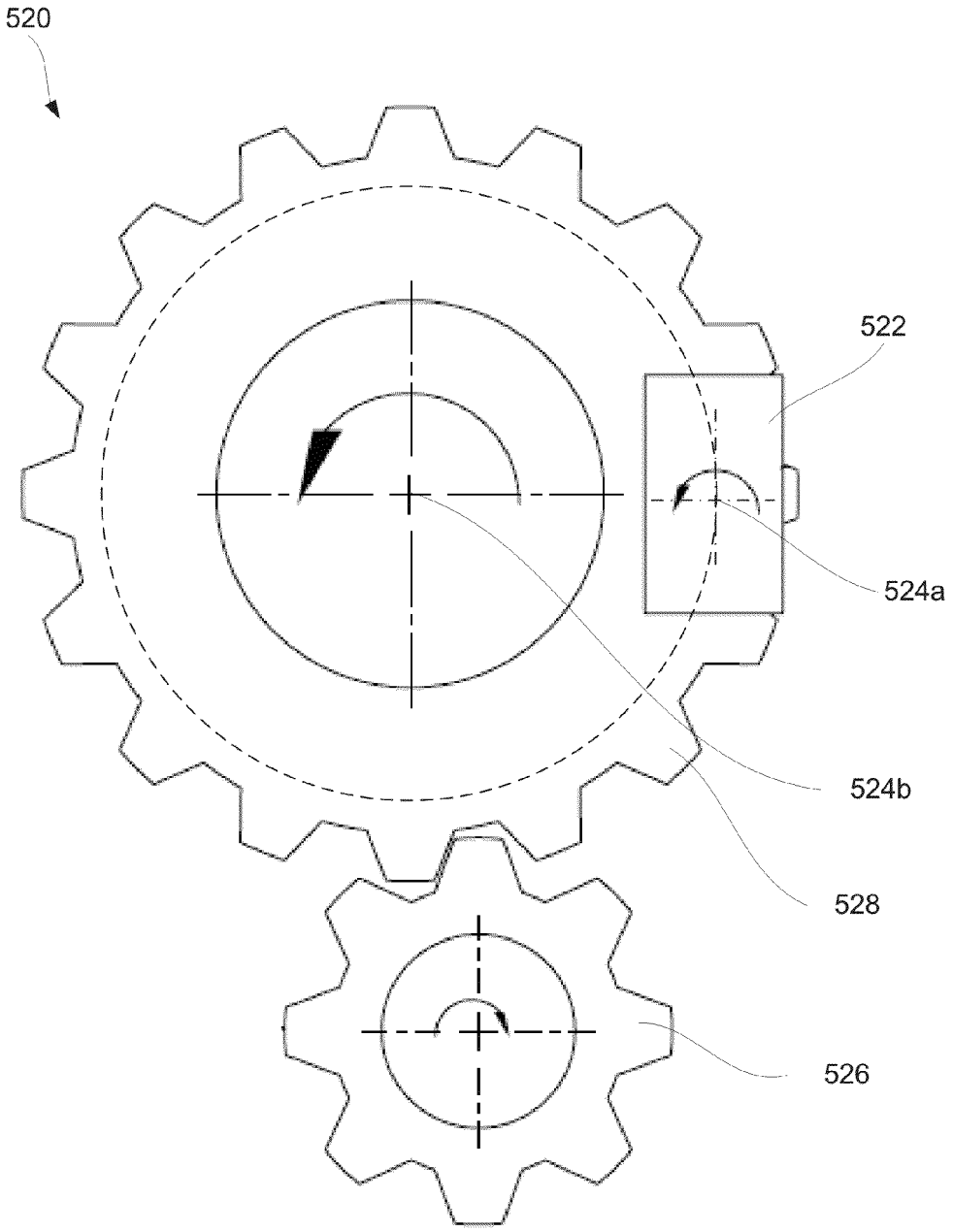
FIG. 5B is a schematic representation of another apparatus for depositing a coating material onto a complex surface of a part using at least two axes of rotation, in accordance with some embodiments.

FIG. 5B is a schematic illustration of another processing apparatus 520, in accordance with some embodiments. Apparatus 520 includes gears 526 and 528 to rotate part 522 around axis 524*b*. The trajectory of this rotation is shown with a dashed circle. Apparatus 520 may also rotate part 522 around axis 524*a* while part 522 is being rotated around axis 524*b*. For example, part 522 may be positioned on another gear (not shown) coupled to gear 528 in such a way that rotation of gear 528 around axis 524*b* causes rotation of part 522 around axis 524*b*. The entire apparatus 520 may be positioned on a vibration table similar to the one illustrated in FIG. 5A.

Figure 5C:
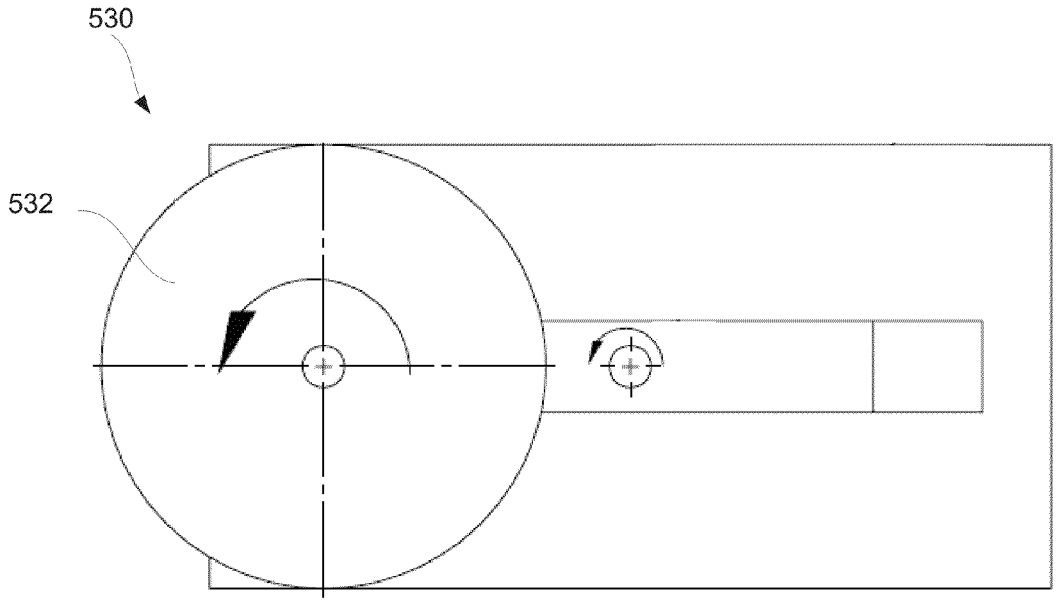
FIGS. 5C and 5D are top and side schematic representations of yet another apparatus for depositing a coating material onto a complex surface of a part using at least two axes of rotation and at least two axes of vibration, in accordance with some embodiments.
Figure 5D:
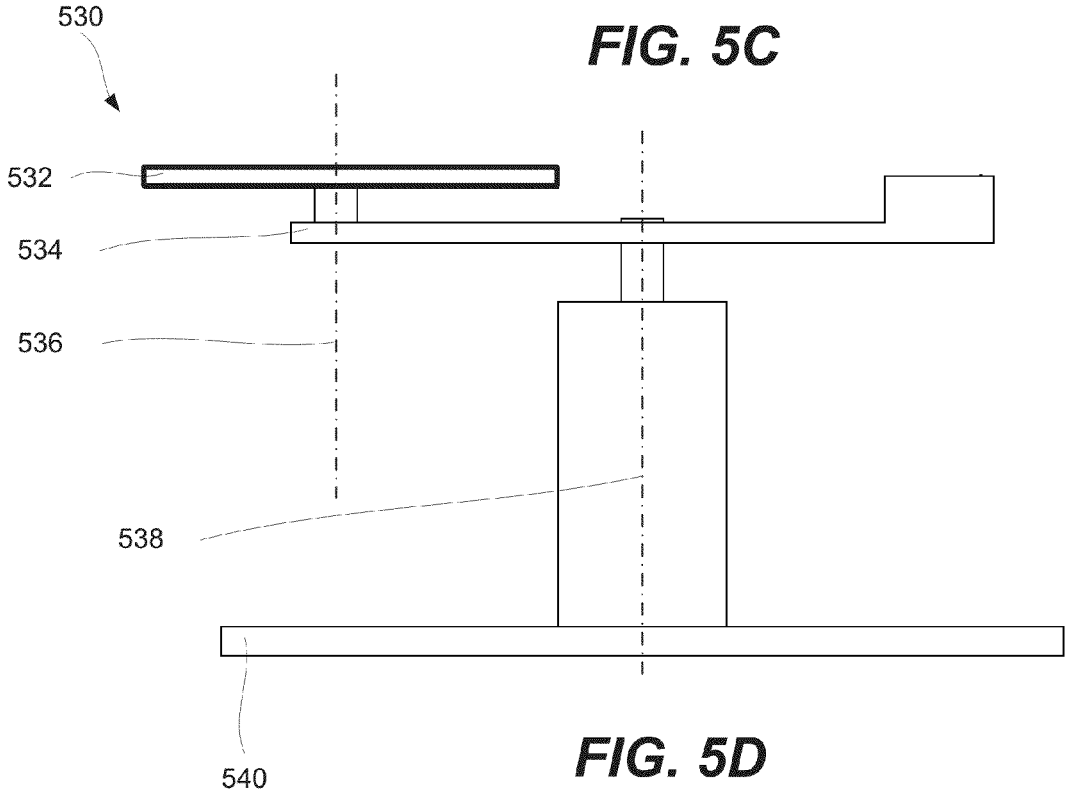

FIGS. 5C and 5D are schematic top and side views of another processing apparatus 530, in accordance with some embodiments. Part 532 is supported on a platform 534, which is configured to rotate part 532 around or about axis 536. Platform 534 itself is configured to rotate around or about axis 538 relative to base 540. Base 540 may be positioned on a vibration table similar to the one illustrated in FIG. 5A.

Experiment Results

Figure 6A:
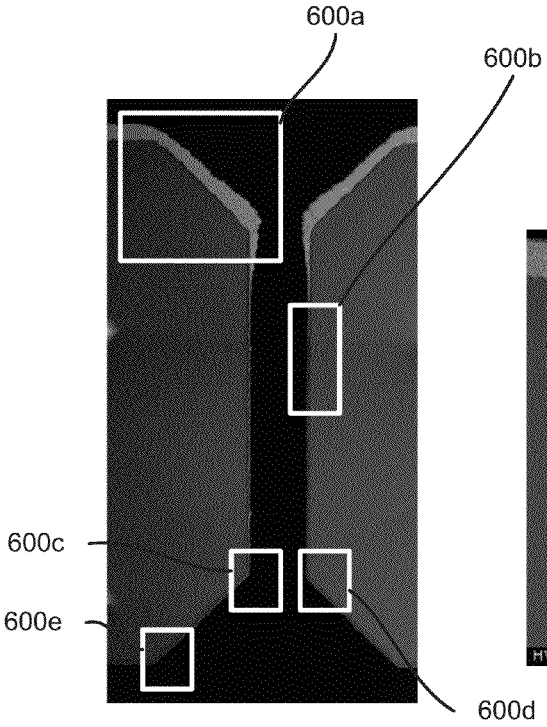
FIGS. 6A-6H are photographs of a cross-section of a part coated using vibration and rotation of the part.

A series of experiments have been conducted to determine effects of combining vibration and rotation to distribute coating materials on complex surfaces. In one experiment, a showerhead having gas supply openings has been tested for coating material distribution. FIG. 6A is a photo of a cross-section of the showerhead illustrating coating material distribution. More specifically, FIG. 6A is a photo of a small portion of a showerhead illustrating one opening extending from the substrate-facing surface of the showerhead. The opening is about 0.5 millimeters in diameter and about 2 millimeters deep. The opening connects the substrate-facing surface with an internal cavity of the showerhead. The showerhead is made of aluminum and has an anodized surface. An yttrium oxide layer was formed on the substrate facing surface over the anodized layer and, to some extent, within the opening using a plasma deposition over the anodized surface. However, plasma deposition is a line-of-sight technique and does not provide a good coverage of complex surfaces. Furthermore, the yttrium oxide layer is typically very porous and non-uniform and susceptible to collecting debris and outgassing. Furthermore, the anodized aluminum layer contains many contaminants that can escape during operation of the showerhead.

The coating material distribution was analyzed from the thickness of the cured material on the substrate facing surface, two tapered inlets into the opening, side walls of the opening, and a portion of the internal cavity. The coating included a combination of aluminum oxide and silicon oxide (i.e., AlOx-SiOy nanocomposite material). The coating operations involved dip coating with horizontal face-down immersion using 100 mm/min immersion and withdrawal linear speeds. After the dip coating, the part was simultaneously vibrated at 16 Hz and rotated at 900 ROM for about 60 seconds. The part was then oven dried for about 20 minutes.

It was determined that the coating material formed a uniform and conformal layer in all areas subjected to inspection, which are identified with numerals 600*a*-600*e* in FIG. 6A and are shown as expanded views in FIGS. 6B-6H. The thickness values for different points are presented in the table below.

TABLE

| Sample | Thickness (micrometers) |
|---|---|
| 1 | 9.5 |
| 2 | 9.1 |
| 3 | 9.5 |
| 4 | 9.3 |
| 5 | 9.2 |
| 6 | 9.2 |
| 7 | 9 |
| 8 | 9.3 |
| 9 | 9.4 |
| Average Thickness | 9.278 |
| Standard Deviation | 0.162 |

Figure 6B:
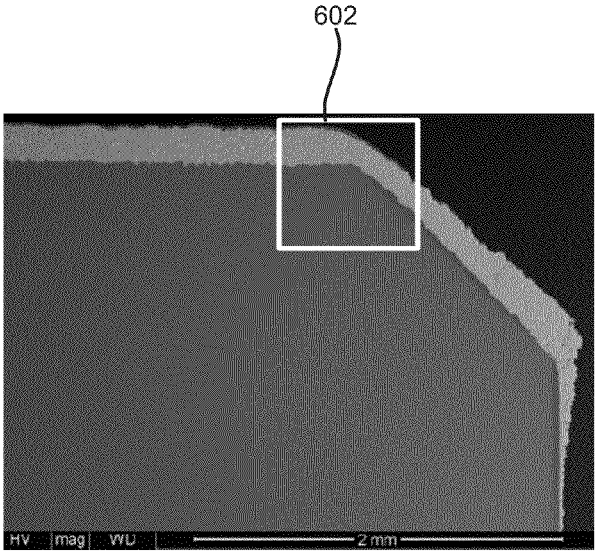
Figure 6C:
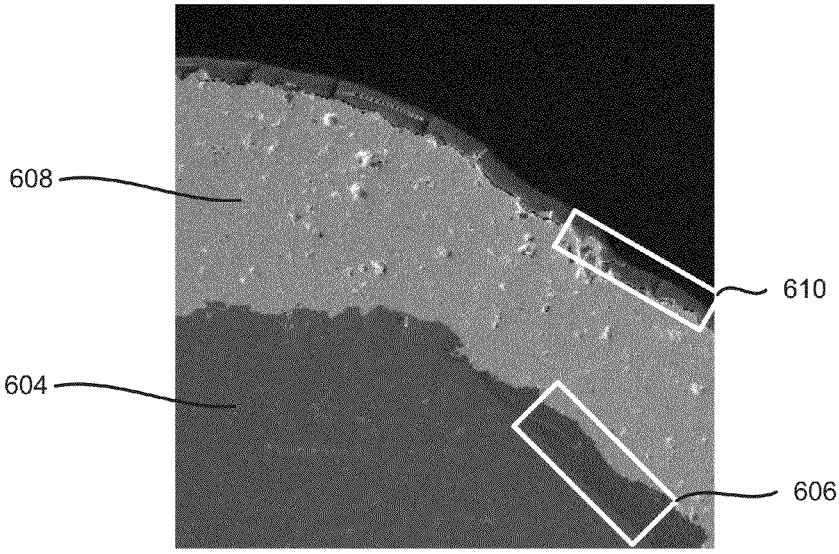

Specifically, area 600*a* corresponds to the inlet into the opening adjacent to the top surface. It should be noted that this is the area may have received the coating material initially (i.e., prior to redistribution of the coating material). An expanded view of area 600*a* is shown in FIG. 6B. A smaller area 602 is identified in FIG. 6B and is presented as an expanded view in FIG. 6C. Numeral 604 corresponds to the aluminum base of the showerhead. Numeral 608 corresponds to the yttrium oxide layer disposed over the aluminum base. Among all layers shown in FIGS. 6A-6C, the yttrium oxide layer has the lightest color. While the yttrium oxide layer seems to be conformal in the portion illustrates in FIG. 6C, one can see that this layer quickly fades away on the side walls of the openings as, for example, shown in FIGS. 6A and 6B. The anodization layer is identified with numeral 606 and has a color darker than the aluminum base (numeral 604) or the yttrium oxide layer (numeral 608). The anodization layer is disposed between the aluminum base (numeral 604) and the yttrium oxide layer (numeral 608). However, as one can see from FIG. 6C, the anodization layer does not provide consistent coverage of the aluminum base. Finally, numeral 610 identifies the coating material. The coating material forms a conformal layer over the yttrium oxide layer as it can be clearly seen in FIG. 6C.

Figure 6D:
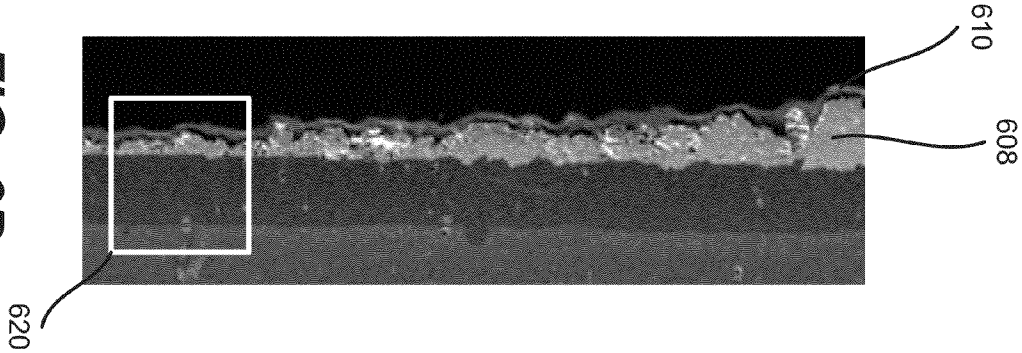
Figure 6E:
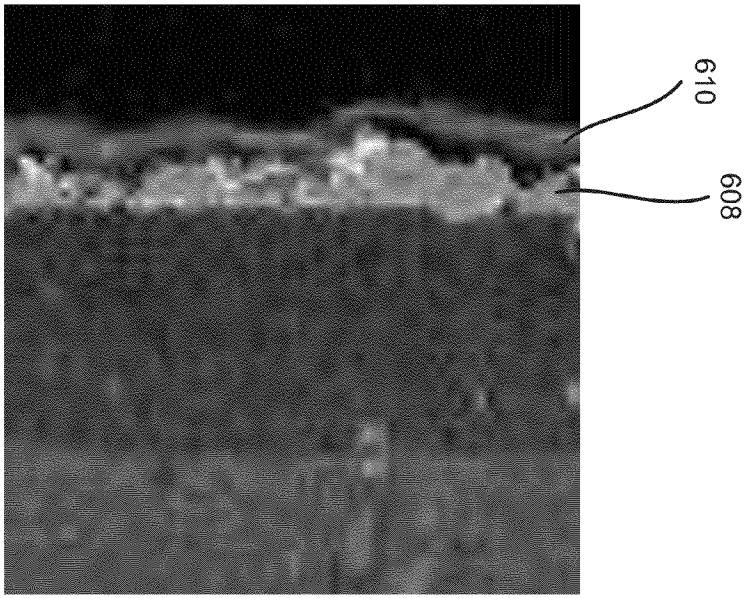

Area 600*b* in FIG. 6A, corresponds to the side wall of the opening. An expanded view of area 600*b* is shown in FIG. 6D. This figure clearly shows that the thickness of the yttrium oxide layer (numeral 608) quickly fades away deeper in the opening. Furthermore, the yttrium oxide layer has a very rough surface. Despite this uneven thickness and surface roughness of the yttrium oxide layer, the coating layer (numeral 610) continues to provide conformal coverage. The conformal coverage can be better seen in an expanded view of area 620 presented in FIG. 6E.

Figure 6F:
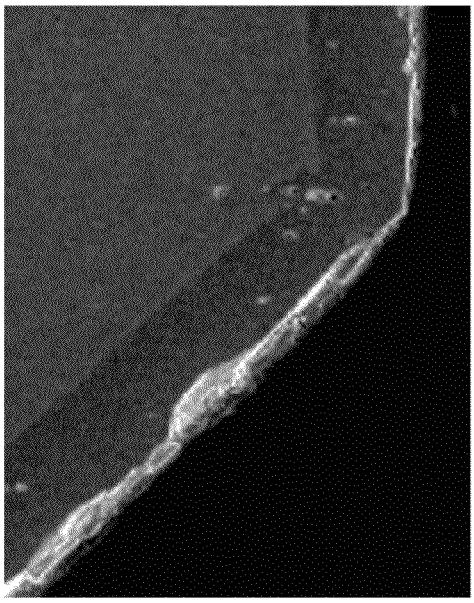
Figure 6G:
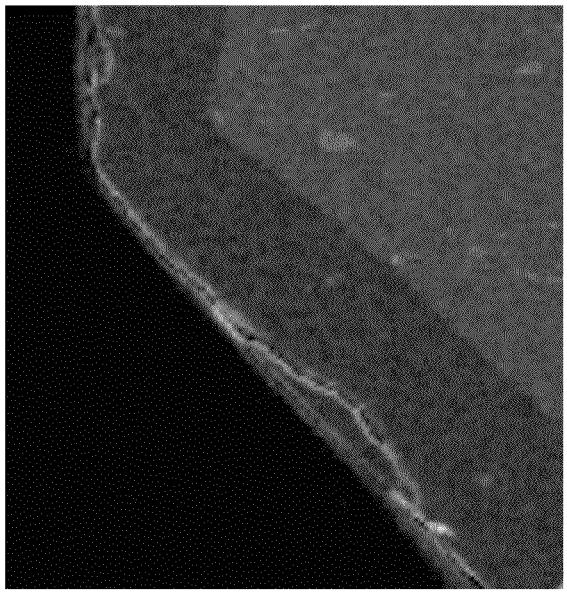
Figure 6H:
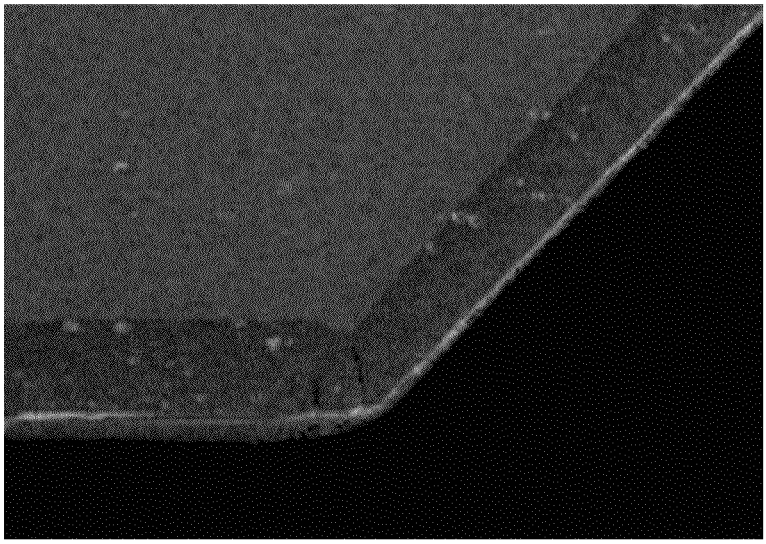

Areas 600*c*-600*e* in FIG. 6A correspond to the inlet into the opening from the internal cavity side. These areas are hidden and generally not accessible to line of sight deposition techniques. An expanded view of area 600*c* is shown in FIG. 6F, an expanded view of area 600*d* is shown in FIG. 6G, and, finally, an expanded view of area 600*e* is shown in FIG. 6H. As expected, very little, if any, yttrium oxide is present in these areas. However, the coating material continues to provide conformal protection to the aluminum anodization even in these hidden areas. Similar test results were achieved with an electrostatic chuck that has an aluminum base, an anodized coating, and a plasma deposited yttrium oxide layer.

In another experiment, a coating material was applied onto a bare aluminum surface or, more specifically, onto a bead-blasted aluminum surface. A showerhead with different design openings (i.e., two step openings) was tested in this experiment. It was determined that the coating material again formed a uniform and conformal layer over the entire complex surface that was inspected. The coating included an AlOx-SiOy nanocomposite material. The coating was first applied using vertical dip coating at 100 mm/min immersion and withdrawal liner speeds. The subsequent steps included vibration at 10 Hz and first rotation at 300 RPM with face up, followed by second rotation at 500 RPM with face down. The curing was performed in a convection oven for 30 minutes.

Figure 7A:
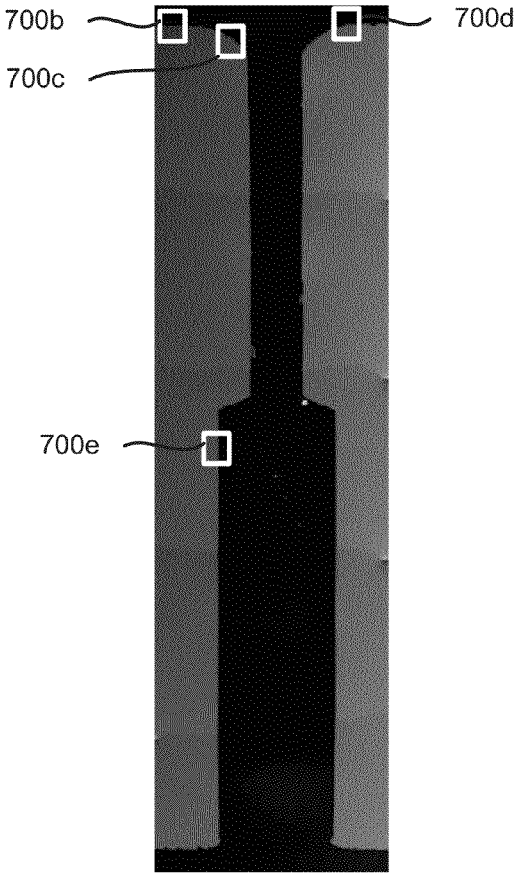
FIGS. 7A-7E are photographs of a cross-section of another part coated using vibration and rotation of the part.
Figure 7B:
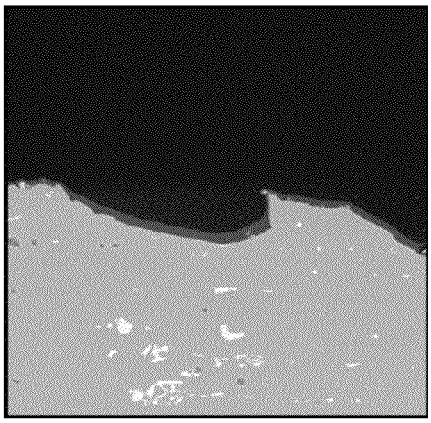
Figure 7C:
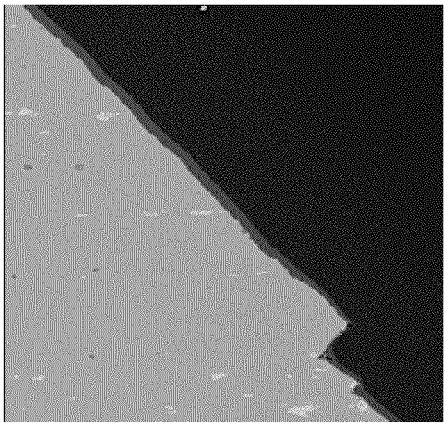
Figure 7E:
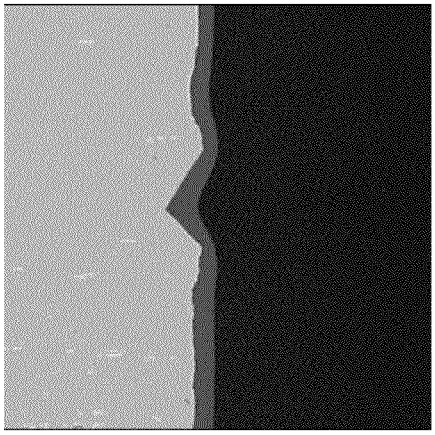
Figure 7D:
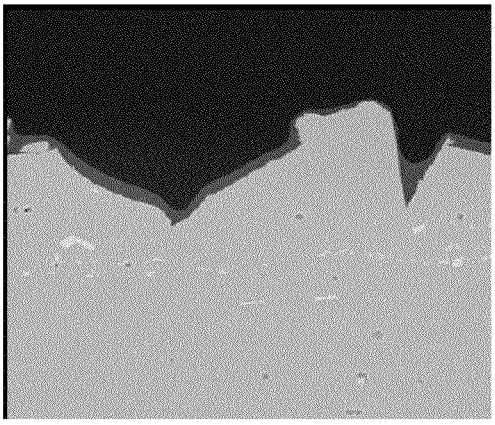

A few areas of that surface identified with numerals 700*b*-700*e* in FIG. 7A are shown as expanded views in FIGS. 7B-7E and described in more detail with reference to those figures. Specifically, areas 700*b*-700*d* correspond to the inlet into the opening adjacent to the top surface. An expanded view of area 700*b* is shown in FIG. 7B, an expanded view of area 700*c* is shown in FIG. 7*c*, and an expanded view of area 700*d* is shown in FIG. 7D. Despite surface roughness, a conformal layer of the coating material is formed in each of these areas. Furthermore, area 700*e* corresponds to a side wall of the opening and its expanded view is shown in FIG. 7E. Even though area 700*e* is not within a line of sight and is relatively deep within an narrow opening, it is also received a conformal layer of the coating material.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A method for depositing a coating material, the method comprising:

depositing an initial layer of a coating material on at least a portion of a surface of a part;

redistributing the coating material in the initial layer to form a modified layer using a first set of process conditions comprising simultaneously rotating and vibrating the part;

redistributing the coating material in the modified layer using a second set of process conditions comprising simultaneously rotating and vibrating the part, wherein redistributing the coating material using the first set of process conditions creates a different combination of centrifugal and inertial forces acting on the coating material than redistributing the coating material using the second set of process conditions; and determining the first set of process conditions and the second set of process conditions, wherein orientation of the part with respect to a rotational axis in the first set of process conditions is different than in the second set of process conditions.

2. The method of claim 1, further comprising, prior to depositing the initial layer, disposing an activation solution on the surface of the part.

3. The method of claim 2, wherein disposing the activation solution on the surface comprises vibration and rotation of the part while the surface of the part is immersed into the activation solution.

4. The method of claim 1, wherein determining the first set of process conditions and the second set of process conditions is performed based on a computer aided design (CAD) of the part.

5. The method of claim 1, wherein, after depositing the initial layer and before redistributing the coating material in the initial layer, at least some of the surface remains uncovered by the coating material.

6. The method of claim 1, wherein the coating material is thixotropic.

7. The method of claim 1, wherein the portion of the surface covered with the coating material increases during redistributing the coating material in the initial layer.

8. The method of claim 1, wherein a thickness of the modified layer is more uniform than a thickness of the initial layer.

9. The method of claim 1, wherein the first set of process conditions accounts for one or more gravitational forces or aerodynamic forces operable on the coating material during redistributing the coating material in the initial layer.

10. The method of claim 1, wherein a vibration frequency in the first set of process conditions is different from a vibration frequency in the second set of process conditions.

11. The method of claim 1, further comprising, after redistributing the coating material in the initial layer and prior to redistributing the coating material in the modified layer, depositing an additional coating material to at least the portion of the surface of the part.

12. The method of claim 11, wherein the additional coating material is more viscous than the coating material.

13. The method of claim 1, wherein further comprising curing the coating material on the surface.

14. The method of claim 13, wherein curing is performed while simultaneous rotating and vibrating the part.

15. The method of claim 13, wherein at least one of wavelength or intensity is changed during curing the coating material.

16. A method for depositing a coating material, the method comprising:

depositing an initial layer of a coating material on at least a portion of a surface of a part;

redistributing the coating material in the initial layer to form a modified layer using first set of process conditions comprising simultaneously rotating and vibrating the part; and redistributing the coating material in the modified layer using a second set of process conditions comprising simultaneously rotating and vibrating the part, wherein redistributing the coating material using the first set of process conditions creates a different combination of centrifugal and inertial forces acting the coating material than redistributing the coating material using the second set of process conditions, and wherein the part is simultaneously vibrated along a first axis and along a second axis while redistributing the coating material using the first set of process conditions, and wherein the first axis is not parallel to the second axis.

17. The method of claim 16, wherein the first axis is orthogonal to the second axis.

18. The method of claim 16, wherein the part is vibrated along the first axis using a first frequency, wherein the part is vibrated along the second axis using a second frequency, and wherein the first frequency is different from the second frequency.

19. The method of claim 16, wherein the part is vibrated along the first axis using a first frequency, wherein the part is vibrated along the second axis using a second frequency, wherein the first frequency is same as the second frequency, and wherein a vibration cycle of vibration along the first axis is offset with respect to a vibration cycle of vibration along the second axis.

* * * * *